US009705244B1

(12) United States Patent
Liu

(10) Patent No.: US 9,705,244 B1
(45) Date of Patent: Jul. 11, 2017

(54) ELECTRIC CONNECTOR

(71) Applicant: Amphenol East Asia Electronic Technology (Shen Zhen) Co., Ltd., Shenzhen (CN)

(72) Inventor: Fei Liu, Shenzhen (CN)

(73) Assignee: Amphenol East Asia Electronic Technology (Shen Zhen) Co., Ltd., Shenzhen (CN)

( * ) Notice: Subject to any disclaimer, the term of this patent is extended or adjusted under 35 U.S.C. 154(b) by 0 days.

(21) Appl. No.: 15/385,434

(22) Filed: Dec. 20, 2016

(51) Int. Cl.
*H01R 13/62* (2006.01)
*H01R 13/621* (2006.01)
*H01R 13/631* (2006.01)

(52) U.S. Cl.
CPC ..... *H01R 13/6215* (2013.01); *H01R 13/6315* (2013.01)

(58) Field of Classification Search
CPC ..... H01R 13/6215; H01R 13/62153
See application file for complete search history.

(56) References Cited

U.S. PATENT DOCUMENTS 2,954,542 A * 9/1960 Wales ..... H01R 13/6315 439/252
3,539,973 A * 11/1970 Wright ..... H01R 13/7197 439/607.07
4,519,667 A * 5/1985 Canning ..... H01R 13/6453 439/681
6,179,637 B1 * 1/2001 Lee ..... H02B 11/12 439/248
7,074,065 B1 * 7/2006 Martinez ..... H01R 13/6315 439/247
2003/0040228 A1 * 2/2003 Finzer ..... F16B 29/00 439/752
2014/0120760 A1 * 5/2014 Zieman ..... H01R 12/91 439/357
2014/0170886 A1 * 6/2014 Kikuchi ..... H01R 12/7082 439/345
2015/0126054 A1 * 5/2015 Hoyack ..... H01R 24/542 439/246
2015/0372417 A1 * 12/2015 Dieduksman ..... G02B 6/3807 439/461
2016/0164233 A1 * 6/2016 Zhu ..... H01R 24/542 439/248

* cited by examiner

*Primary Examiner* — Briggitte R Hammond
(74) *Attorney, Agent, or Firm* — Maier & Maier, PLLC

(57) ABSTRACT

The electric connector includes an outer shell, at least one terminal, at least one floating resilient part, at least one screw and a panel. The outer shell includes at least one terminal groove and at least two fastening grooves. The floating resilient part includes at least one inner resilient tab and at least one outer resilient tab. The terminal groove is provided at the middle portion of the outer shell and has an end opening provided at the center of the panel. The fastening grooves are respectively provided at two sides of the outer shell and have end openings provided at two sides of the panel. The terminal is pluggable into the terminal groove, and a head of the terminal passing through the ending opening of the terminal groove is connected with a terminal of a mating connector.

3 Claims, 1 Drawing Sheet

ELECTRIC CONNECTOR

TECHNICAL FIELD

The present application relates to the field of connector, particularly to an electric connector.

BACKGROUND

An electric connector is a conductor device leading a current from one arrangement to another. Currently, an electric connector, allowing for a current of 30 Amperes, is mainly used in a changeover mechanism of Cloud Service's data center.

Nowadays, two of the disadvantages of existing electric connectors are that: a male plug and a female receptacle of the electric connector are prone to be misaligned with each other while plugging, which will result in potential safety hazard consequently; the male plug and the female receptacle are not firmly secured to each other, which will also result in potential safety hazard.

SUMMARY OF THE APPLICATION

To overcome the above described disadvantages, the present application provides an electric connector with optimized structure which ensures the male plug and the female receptacle of the electric connector are properly plugged and securely connected with each other.

To achieve the above described objective, the present application provides an electric connector comprising:

an outer shell, including at least one terminal groove and at least two fastening grooves;

at least one terminal;

at least one floating resilient part, including at least one inner resilient tab and at least one outer resilient tab;

at least one screw; and a panel, wherein the terminal groove is provided at the middle of the outer shell and has an end opening provided at the center of the panel;

wherein the fastening grooves are respectively provided at two sides of the outer shell, and have end openings provided at two sides of the panel;

wherein the terminal is provided to be pluggable into the terminal groove and has a head passing through the end opening of the terminal groove to connect with a terminal of a mating connector wherein the floating resilient part is tube-shaped and is pluggable into the fastening groove, and the outer resilient tab abuts against an inner wall of the fastening groove;

wherein the inner resilient tab is provided at a tube wall of the floating resilient part and extends into the floating resilient part;

wherein the outer resilient tab is provided at the tube wall of the floating resilient part and extends out of the floating resilient part; and wherein the screw is pluggable into the floating resilient part to abut against the inner resilient tab, and a head of the screw extends out of the end opening of the fastening groove to be threadedly connected to the mating connector.

In a further optimized technical solution, the outer shell is made from insulating plastics.

In a further optimized technical solution, the panel is provided on a surface of the outer shell.

Following beneficial effects are achieved by the present application due to the employment of the above described technical solutions.

Compared with the prior art, the beneficial effects are that: the present electric connector, by adding at least one floating resilient part to an existing connector, can be floated so that the present electric connector will be correctly plugged into other equipment. The connection between the present electric connector and said other equipment can be strengthened by the screw.

DETAILED DESCRIPTION

The present application will be detailed in connection with FIGS. 1 and 2 and the specific embodiments as well, which are in no way intended to limit the present application.

Embodiment 1

Figure 1:
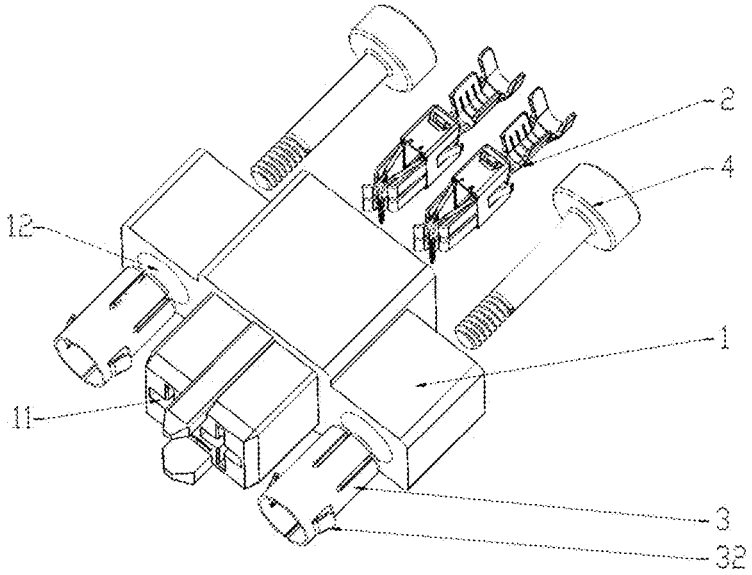
FIG. 1 is an exploded view of an electric connector.
Figure 2:
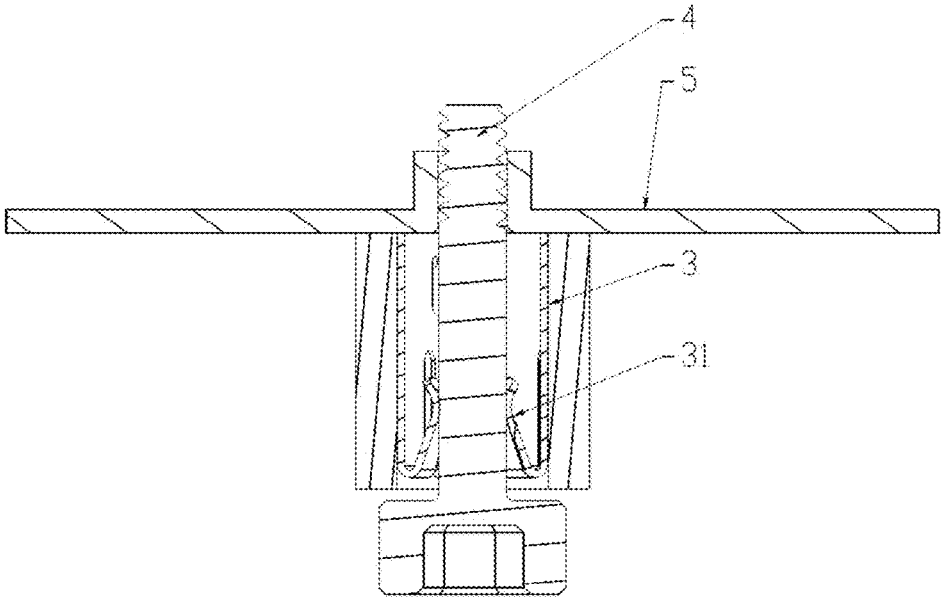
FIG. 2 is a cross-sectional view of an electric connector.

As shown in FIGS. 1 and 2, an electric connector comprises an outer shell 1, at least one terminal 2, at least one floating resilient part 3, at least one screw 4 and a panel 5. The outer shell 1 includes at least one terminal groove 11 and at least two fastening grooves 12. The floating resilient part 3 includes at least one inner resilient tab 31 and at least one outer resilient tab 32.

The outer shell 1 is made from insulating plastics. The terminal groove 11 is provided at the middle of the outer shell 1 and has an end opening provided at the center of the panel 5. The fastening grooves 12 are respectively provided at two sides of the outer shell 1 and have end openings provided at two sides of the panel 5.

The terminal 2 is provided to be pluggable into the terminal groove 11, and the head of the terminal 2 passing through the end opening of the terminal groove 11 is connected with a terminal of mating connector.

The floating resilient part 3 is tube-shaped and is pluggable into the fastening groove 12, and the outer resilient tab 32 abuts against an inner wall of the fastening groove 12. The inner resilient tab 31 is provided at a tube wall of the floating resilient part 3 and extends into the floating resilient part 3. The outer resilient tab 32 is provided at the tube wall of the floating resilient part 3 and extends out of the floating resilient part 3.

The screw 4 is pluggable into the floating resilient part 3 to abut against the inner resilient tab 31. A head of the screw 4 extends out of the end opening of the fastening groove 12 to be threadedly connected to the mating connector.

The panel 5 is provided on a surface of the outer shell 1.

In light of general technical knowledge, present technical solutions can be achieved by other embodiments which are not departed from spiritual substance or essential features of the application. Therefore, above described embodiments are simply illustrative in any way and are not intended to limit the application. All the changes within the range of the application or its equivalent are included the application itself.

The invention claimed is:

1. An electric connector comprising:

an outer shell, including at least one terminal groove and at least two fastening grooves;

at least one terminal;

at least one floating resilient part, including at least one inner resilient tab and at least one outer resilient tab;

at least one screw; and a panel, wherein the terminal groove is provided at the middle of the outer shell and has an end opening provided at the center of the panel;

wherein the fastening grooves are respectively provided at two sides of the outer shell (1) and have end openings provided at two sides of the panel;

wherein the terminal is provided to be pluggable into the terminal groove and has a head passing through the end opening of the terminal groove to connect with a terminal of a mating connector wherein the floating resilient part is tube-shaped and is pluggable into the fastening groove, and the outer resilient tab abuts against an inner wall of the fastening groove;

wherein the inner resilient tab is provided at a tube wall of the floating resilient part and extends into the floating resilient part;

wherein the outer resilient tab is provided at the tube wall of the floating resilient part (3) and extends out of the floating resilient part; and wherein the screw is pluggable into the floating resilient part to abut against the inner resilient tab, and a head of the screw extends out of the end opening of the fastening groove to be threadedly connected to the mating connector.

2. The electric connector as set forth in claim 1, wherein the outer shell is made from insulating plastics.

3. The electric connector as set forth in claim 1, wherein the panel is provided on a surface of the outer shell.

* * * * *